United States Patent [19]

Macierewicz

[11] Patent Number: 4,640,780

[45] Date of Patent: Feb. 3, 1987

[54] UNPLUGGING OF HEAVY FRACTION OUTLET HYDROCYCLONE

[75] Inventor: Jacek J. Macierewicz, Calgary, Canada

[73] Assignee: ELP Products Ltd., Calgary, Canada

[21] Appl. No.: 736,475

[22] Filed: May 21, 1985

[30] Foreign Application Priority Data

Jun. 4, 1984 [CA] Canada ..... 455797

[51] Int. Cl.[4] ..... B04C 5/18; B04C 5/23

[52] U.S. Cl. ..... 210/512.2; 209/144; 209/211; 210/512.3; 210/541; 210/542

[58] Field of Search ..... 209/144, 211; 210/512.1, 512.2, 512.3, 304, 787, 788, 541, 542

[56] References Cited

U.S. PATENT DOCUMENTS

| | | |
|---|---|---|
| 1,932,226 | 10/1933 | Pierce . |
| 2,328,948 | 9/1943 | Bourke . |
| 2,704,172 | 3/1955 | Lapin . |
| 2,953,248 | 9/1960 | Troland . |
| 2,964,220 | 12/1960 | Appél . |
| 3,131,712 | 5/1964 | Risley et al. . |
| 3,170,607 | 2/1965 | Anthon . |
| 3,214,022 | 10/1965 | Wikdahl . |
| 3,410,323 | 11/1968 | Richard et al. . |
| 3,906,989 | 9/1975 | Lamb . |
| 4,084,606 | 4/1978 | Mittleman . |
| 4,198,302 | 4/1980 | Johansson . |
| 4,205,767 | 6/1980 | Shackelford . |
| 4,240,630 | 12/1980 | Hoffman . |
| 4,356,084 | 10/1982 | Hatton et al. . |

FOREIGN PATENT DOCUMENTS

| | | |
|---|---|---|
| 525562 | 5/1956 | Canada . |
| 543642 | 7/1957 | Canada . |
| 610951 | 12/1960 | Canada . |
| 642160 | 6/1962 | Canada . |
| 643894 | 7/1962 | Canada . |
| 647355 | 8/1962 | Canada . |
| 634254 | 12/1962 | Canada . |
| 658102 | 2/1963 | Canada . |
| 798156 | 11/1968 | Canada . |
| 885026 | 11/1971 | Canada . |
| 1034156 | 7/1978 | Canada . |
| 1132161 | 9/1982 | Canada . |
| 1143341 | 3/1983 | Canada . |
| 1203779 | 4/1986 | Canada . |

OTHER PUBLICATIONS

Chemical Engineering, Jun. 1955–"Wet Cyclones", by O. F. Tangel and R. J. Brison.

*Primary Examiner*—Frank Sever

*Attorney, Agent, or Firm*—Killworth, Gottman, Hagan & Schaeff

[57] ABSTRACT

A hydrocyclone heavy fraction outlet unplugging grommet for use in hydrocyclone systems is described. The grommet is self-sealing under the pressures encountered in use and will effectively seal around a relatively large water nozzle inserted therethrough in the course of an unplugging operation.

13 Claims, 6 Drawing Figures

UNPLUGGING OF HEAVY FRACTION OUTLET HYDROCYCLONE

BACKGROUND OF THE INVENTION

This invention relates to a sealing grommet which is especially suitable for (although not so limited) to use in the unplugging of a hydrocyclone heavy fraction outlet during operation under pressure and without spillage or spraying of fluids to the outside and to hydrocyclone systems incorporating such grommets. The invention has particular application to multiple hydrocylone arrangements disposed in pressurized cannisters or arranged in banks.

The known multicyclone arrangements either do not provide such facilities or else they use one of two basic concepts in an effort to deal with the problem.

The system employed by Celleco AB is based on providing a nylon plug that can be removed entirely or else twisted in its guides to expose a hole on the extension of the hydrocyclone centre line behind the heavy fraction opening. Through this slightly oversized hole, a ¼ inch diameter high pressure water nozzle may be inserted. By using the flushing water jet stream in combination with the ramming action of the tip of the nozzle the plugged hydrocyclone may be unplugged "on the run". The deficiency of this solution resides in the necessity of opening the nylon plug while the heavy fraction chamber or reject header is under pressure, and thus before or even during the unplugging operation there is a lot of spraying or spilling of hot fluid suspension onto the operator attempting to accomplish this task.

The Black Clawson Co. uses a special purge gun kit. When, in looking through a sight glass, the operator notices that the discharge from the hydrocyclone has ceased, it is evident that the heavy fraction discharge opening is plugged. He then pushes a purge gun needle through a soft rubber purge button and into the tip of the hydrocyclone. A blast of water at 500 psi slices through the packed heavy solids until the tip of the needle is beyond the packed plug. A combination of the water blast and vibration of the needle clears the plug. As the needle is withdrawn, the soft rubber purge button collapses behind it, sealing its exit. If any minor leakage occurs, a set screw, capable of squeezing the punctured purge button, can be tightened to stop such leakage. To obtain these sealing conditions after unplugging, the hypodermic-type purge gun needle used must be very thin, thus bending easily and supplying very little flow—just above 0.5 GPM at 500 psi. Hence, its effectiveness is rather limited in many instances.

BRIEF SUMMARY OF THE PRESENT INVENTION

To alleviate the problems associated with the above described arrangements, the present invention provides:

a resilient grommet especially suited for use as a hydrocyclone reject outlet unplugging grommet and which will allow relatively large and sturdy (e.g. ¼ inch diameter) water nozzles to be used;

an unplugging grommet that is self-sealing under the influence of the pressure in the reject chamber of a hydrocyclone separator system;

a hydrocyclone heavy fraction outlet unplugging grommet that will effectively seal around the inserted water nozzle;

an unplugging grommet with easy mounting features allowing it to be easily set into various types of housings, sight glasses, or the like;

a hydrocyclone system employing the novel self-sealing grommet referred to above.

Thus, in one aspect the invention provides a resilient grommet adapted to be mounted in a suitable system, (such as a hydrocyclone separator system with the grommet in alignment with the heavy fraction outlet of an associated hydrocyclone), said grommet having a passage therethrough adapted to permit a flushing nozzle or the like to be inserted from the outside of the system into, in the case of a hydrocyclone system, the heavy fraction housing or chamber of said system and into said heavy fraction outlet, said grommet having a body portion which, in use, is exposed to the fluid pressures existing in said housing or chamber, with said body portion being adapted to be compressed and to deform under such pressures to (a) cause a first portion of such passage to form a tight leak proof seal around said nozzle when inserted and (b) cause a second portion of such passage to close tightly on itself when the nozzle has been withdrawn to prevent leakage of fluids along such passage.

The invention further relates to hydrocyclone systems employing the novel grommet recited above.

Further significant aspects of the invention are set out in the claims appended hereto.

Preferred embodiments of the invention will now be described, reference being had to the drawings described below.

DESCRIPTION OF THE PREFERRED EMBODIMENT

Figure 1:
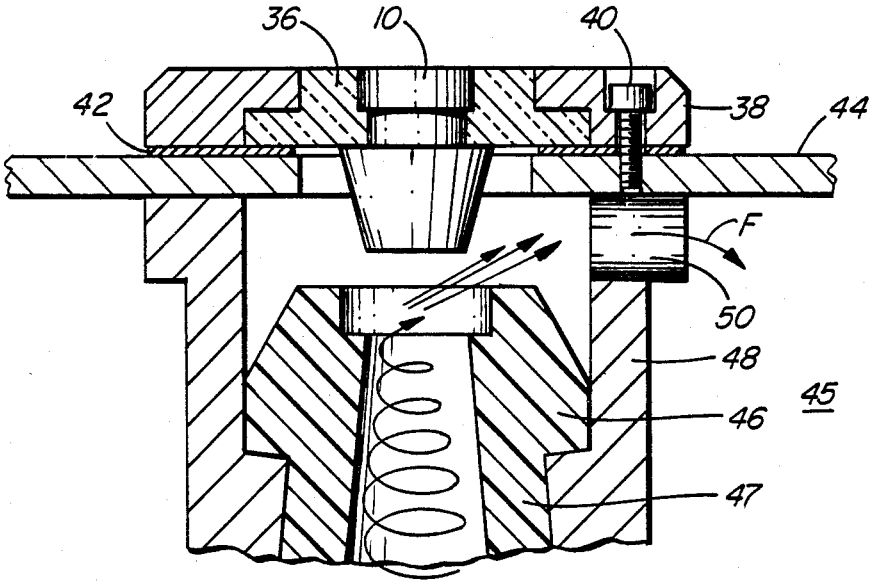
FIG. 1 is a section view showing the unplugging grommet in a hydrocyclone cannister arrangement.

As shown in FIG. 1 a resilient grommet 10 in accordance with the invention is set in a sight glass 36 which is sealingly framed in cap 38, using screws 40 and gasket 42. The cap encloses a hole in the wall 44 of a hydrocyclone cannister, which wall 44 separates its pressurized heavy fraction chamber 45 from the atmosphere. (As is well known in the art, the cannister contains a plurality of hydrocyclones which in one version are disposed radially in vertically spaced annular layers. In another version, the hydrocyclones may extend parallel to one another. The cannister interior includes separate feed, accept, and heavy fraction or reject chambers with walls separating these chambers from one another and sealingly engaged with the hydrocyclones such that the feed inlets, accepts and heavy fraction outlets thereof communicate with the respective chambers noted above.) This wall 44 may be a top lid of a cannister in one design or an outer cylindrical cannister wall in another design. The heavy fraction discharge tip 46 of a conventional hydrocyclone 47 is shown as having a distance stop or spacer 48 and the heavy fraction F emerging from discharge tip 46 passes into the reject chamber 45 via a port 50. Grommet 10 is axially aligned with the longitudinal axis of its associated hydrocyclone.

Figure 2:
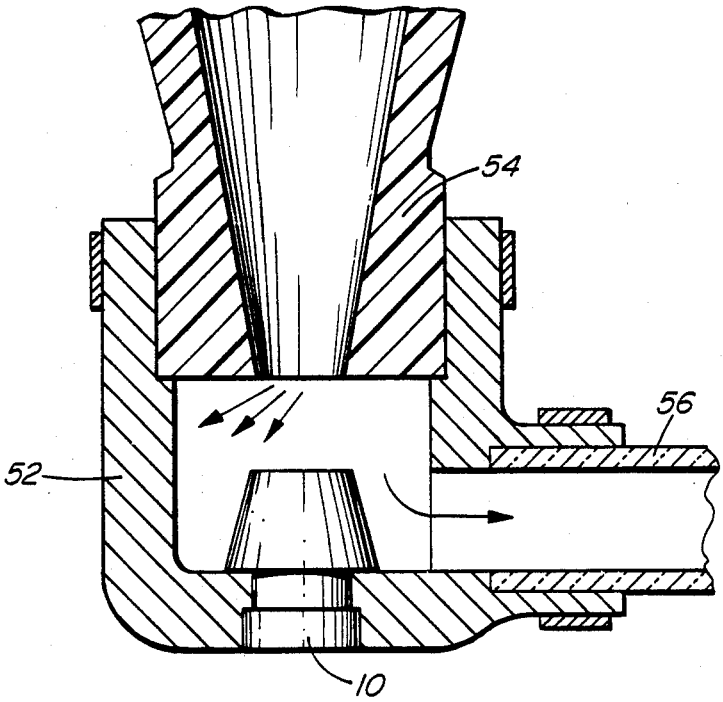
FIG. 2 is a section view showing the grommet in a hydrocyclone bank arrangement or individual hydrocyclone operation.

In the alternative configuration of FIG. 2, the rubber grommet 10 is set in a heavy discharge fraction housing 52 that is sealingly attached to the discharge end of a hydrocyclone 54. The heavy fraction flow may be observed through a sight glass tube 56, before it enters a collection header (not shown) common to a multitude of hydrocyclones installed in this bank.

Figure 3:
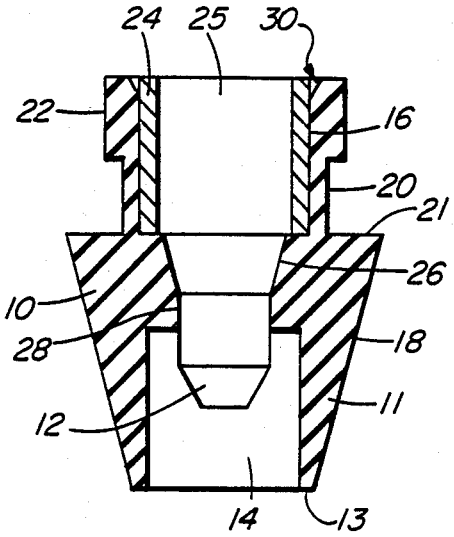
FIG. 3 is a section view of the grommet in one projection.
Figure 4:
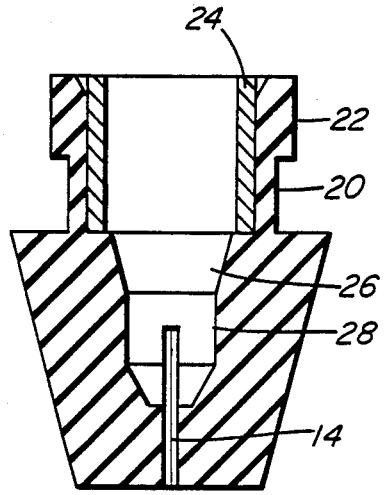
FIG. 4 is a section view of the same grommet taken in a plane perpendicular to that of FIG. 3.
Figure 5:
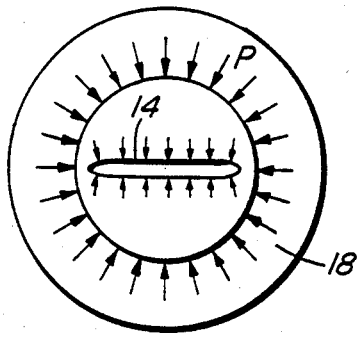
FIG. 5 is a bottom view of the grommet of FIGS. 3 and 4.

As shown in FIGS. 3 to 5 the grommet 10 includes a body portion 11 which projects into the heavy fraction chamber when installed. The body portion 11 has a frustro-conical exterior surface 18, which tapers from its inner end 13 outwardly toward shoulder 21 with its greatest diameter being adjacent the annular step-like shoulder 21 which, in use, sealingly engages with the sight glass 36 noted above. Extending outwardly and away from the body portion 11 is a cylindrical neck 20 which includes, at its outer end, an annular collar 22 which, in use, engages with a corresponding annular step in the hole in the sight glass 36 thereby, with shoulder 21, to secure the grommet 10 in position. An annular metal sleeve 24 is located within the hollow neck portion 20, preventing collapse of the neck portion and ensuring a good seal between the neck 20, its collar 22, and the mating portions formed in the sight glass. A chamfer 30 allows sleeve 24 to be inserted into the hollow neck. Metal sleeve 24 defines an entrance chamber 25 which leads into a funnel-like or conical guide passage 26, which, in turn, leads into a generally cylindrical passage 28 sized so that in use it sealingly engages the exterior of the unplugging nozzle. Passage 28, in turn, leads into a conical transition zone 12, which in turn, leads into a wide slot-like passage 14, called the sealing slot. Entrance chamber 25, guide passage 26, passage 28, transition zone 12 and slot-like passage 14 are all aligned with the longitudinal axis of symmetry of the grommet.

In use, under the influence of fluid pressure in the reject chamber 45, or the reject housing 52, the resilient rubber grommet is compressed inwardly, tightly closing the sealing slot 14 so that its interior walls engage one another and prevent the escape of liquid. The conical exterior shape of the grommet body 11 provides for transfer of fluid pressure in such a way that not only does the annular shoulder 21 tightly engage the sight glass to give a good seal and avoid expulsion of the grommet, but also the sealing slot 14 is tightly closed. A relatively soft resilient rubber should therefore be used. In FIG. 4 the same grommet 10 is shown in section in a plane normal to the section plane of FIG. 3. It illustrates the small transverse dimension of the sealing slot 14, in the unpressurized condition and which, under the influence of pressure "p" in the reject chamber becomes tightly closed.

In FIG. 5 a view from the bottom of grommet 10 is shown illustrating the influence of fluid pressures "p", i.e. the closing of the slot 14 in the grommet to seal against liquid movement therethrough.

Figure 6:
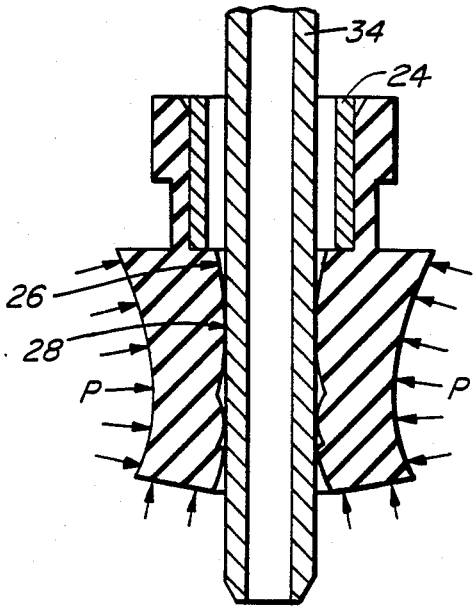
FIG. 6 shows the grommet of FIGS. 3, 4 and 5 in section, while penetrated by a water nozzle during the course of an unplugging operation.

In FIG. 6 the grommet is shown during the unplugging operation. The high pressure water nozzle 34, typically ¼" in diameter, is inserted through the grommet 10. The cylindrical section 28 of the grommet coupled with the resilient action of the rubber under the influence of pressure "p" provides for excellent sealing around the nozzle. The dual sealing action design thus ensures a good fluid seal during normal operation, during the course of the nozzle insertion and during the unplugging operation with the nozzle fully inserted.

Materials of an elastic nature other than rubber may be used provided they exhibit the required resiliency and provide a good seal under the pressures encountered. Other minor modifications and changes will become apparent to those skilled in this art in the light of the above teachings.

I claim:

1. A resilient grommet comprising: means for enabling mounting in a hyrocyclone separator system in the wall of a pressurized heavy fraction chamber thereof and in alignment with the heavy fraction outlet of an associated hydrocyclone, said grommet having a body portion exposed to the pressure in said heavy fraction chamber, said body portion including a passage for receiving means for unplugging said heavy fraction outlet, said passage having first and second portions, said body portion of said grommet being compressible and deformable under said pressure in said heavy fraction chamber to (a) cause said first portion of said passage to form a tight, leakproof seal around said unplugging means inserted, and (b) cause said second portion of said passage to close tightly on itself when said unplugging means has been withdrawn to prevent leakage of fluids along said passage.

2. The resilient grommet of claim 1 wherein said second portion of the passage comprises a slot-like passage located in said body portion and having interior walls which sealingly engage one another under the influence of the fluid pressures when the unplugging means is withdrawn.

3. The resilient grommet of claim 2 wherein said first portion of the passage is generally cylindrical in shape and sized to snugly engage the unplugging means exterior when inserted under the influence of the fluid pressures.

4. The resilient grommet of claim 3 wherein said body portion has a frustro-conical exterior shape with its smallest diameter being adjacent its inner end, i.e. that end which is adjacent the heavy fraction outlet when in use, and said slot-like passage being located adjacent said inner end of the body portion.

5. The resilient grommet of claim 1 wherein the grommet has a hollow neck with a collar portion extending away from said body portion for mounting said grommet in said wall.

6. The resilient grommet of claim 5 wherein there is an annular shoulder between said neck and said body portion so that in use said should abuts said wall of said chamber of said separator to avoid expulsion of the grommet under the internal pressures of said separator.

7. A hydrocyclone separator system comprising: a plurality of hydrocyclones having heavy fraction outlets through which a fluid under pressure is exhausted and means for housing said heavy fraction outlets, the housing means defining at least one space which, when in use, is at an elevated pressure, and in alignment with corresponding ones of said heavy fraction outlets, a plurality of resilient grommets, each resilient grommet comprising a body portion exposed to said elevated pressure in said space, the body portion including a passage for receiving means for unplugging said heavy fraction outlet, the passage including a first portion and a second portion, said body portion of said grommet being compressible and deformable under the elevated pressure to (a) cause said first portion of said passage to form a tight leak proof seal around said unplugging means when inserted, and (b) cause said second portion of said passage to close tightly on itself when said unplugging means has been withdrawn to prevent leakage of fluids along such passage.

8. The separator system of claim 7 wherein said hydrocyclone system employs a cannister wherein said housing defines a heavy fraction chamber and a wall separating such chamber from atmosphere, and said grommets being disposed in openings in said wall in said aligned relationship.

9. The separator system of claim 8 wherein each grommet is mounted in a sight glass to permit observation of the heavy fraction flow from each hydrocyclone.

10. The separator system of claim 8 wherein the hydrocyclones are radially arranged in horizontally disposed layers.

11. The separator system of claim 8 wherein the hydrocyclones are arranged in parallel to one another.

12. The separator system of claim 7 wherein said hydrocyclones are arranged in a bank with said housing means defining a reject housing which is connected to said heavy fraction outlets and said grommets being mounted in said housing in said aligned relationship.

13. The separator system of claim 2 wherein the grommet includes a hollow neck with a collar portion extending away from said body portion for mounting said grommet in a hole in a wall portion of said housing means, and includes a rigid sleeve located in the hollow neck of the grommet to prevent collapse of the neck and help ensure a good seal between the grommet and its mounting.

* * * * *